United States Patent [19]

Bodine

[11] Patent Number: 4,653,587

[45] Date of Patent: Mar. 31, 1987

[54] METHOD AND APPARATUS FOR THE SONIC CEMENTING OF WELLS IN POROUS FORMATIONS

[76] Inventor: Albert G. Bodine, 7877 Woodley Ave., Van Nuys, Calif. 91406

[21] Appl. No.: 830,731

[22] Filed: Feb. 19, 1986

[51] Int. Cl.[4] ..... F21B 33/14

[52] U.S. Cl. ..... 166/286; 166/290; 166/177

[58] Field of Search ..... 166/285, 286, 290, 177, 166/249

[56] References Cited

U.S. PATENT DOCUMENTS

| | | | |
|---|---|---|---|
| 2,156,207 | 4/1939 | Terrill | 166/290 X |
| 2,646,124 | 7/1953 | Strickler | 166/290 X |
| 3,130,552 | 4/1964 | Bodine, Jr. | 166/286 X |
| 3,239,005 | 3/1966 | Bodine, Jr. | 166/286 |
| 3,557,875 | 1/1971 | Solum | 166/286 |
| 4,093,028 | 6/1978 | Brandon | 166/286 X |
| 4,393,932 | 7/1983 | Bodine | 166/249 |
| 4,512,401 | 4/1985 | Bodine | 166/249 |

*Primary Examiner*—Stephen J. Novosad
*Assistant Examiner*—David J. Bagnell
*Attorney, Agent, or Firm*—Edward A. Sokolski

[57] ABSTRACT

A method and apparatus for forming an annulus around the outer wall of a well casing to provide a good impervious seal around such casing which is particularly useful where the casing is installed in a porous earthen formation. A first batch of cement is fed down to the bottom of an oil well casing and out the bottom thereof so that it rises up along the wall of the casing to form an annulus between the casing and the earthen formation in which it is installed. While the cement is being fed and thereafter, the casing is continually vibrated with sonic energy preferably at a frequency which sets up resonant standing wave vibration of the casing. When a layer of the cement has risen to a predetermined level, the feeding of the cement is interrupted but the sonic energization of the well casing continued. After a sufficient time has been allowed for initial hardening of the cement in the surrounding formation a second batch of cement is poured, the second batch of cement flowing further up along the pipe through the fluidized immediately adjacent to the casing and being prevented from entering the porous formation by virtue of the portion of the previously poured cement which has sealed off the lower portions of the formation. Pouring of cement is thus continued in successive interrupted steps or relatively slowly until a sealing annulus of cement reaches the surface.

3 Claims, 2 Drawing Figures

METHOD AND APPARATUS FOR THE SONIC CEMENTING OF WELLS IN POROUS FORMATIONS

Figure 1A:
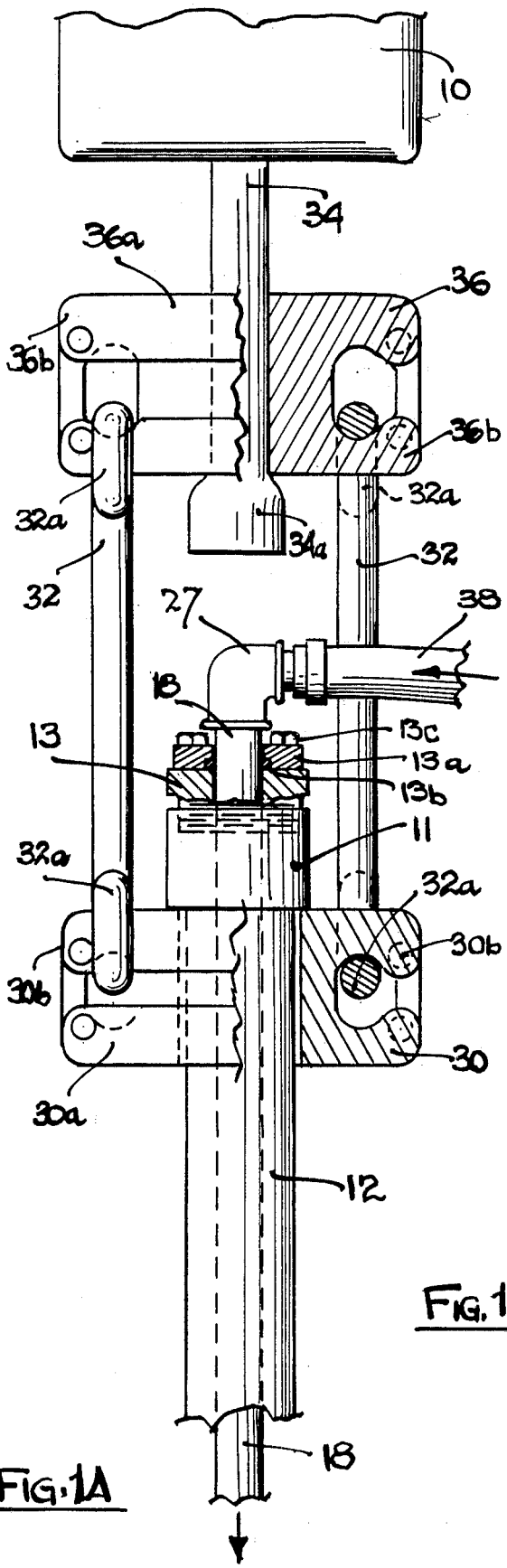

This invention relates to the servicing of oil wells to form a cement annulus around the casings thereof and more particularly, to an improved technique employing sonic energy to facilitate the formation of such an annulus in a situation where the casing is installed in a porous formation.

In connection with the finishing of deep wells such as in the case of oil wells, it is standard practice to place a lining in the form of a steel casing in the well bore. This casing generally includes sections which are threadably joined together and lowered into the well immediately after it is drilled and while it is still full of drill mud. The casing is useful in preventing side wall caving and provides a strong retainer to withstand jolts from subsequent mechanical operations, thus keeping the well open. After the casing has been installed in position, concrete is often poured therein and allowed to rise up along the outer casing walls to form a sealing annulus therearound so as to prevent fluids from leaking up the well around such outer walls. In my U.S. Pat. No. 4,512,401 a method for forming such a cementitious annulus around a casing is described which method employs sonic energy to fluidize the particles of cement and mud. This assures that the cement fills the area around the casing in a uniform manner while releasing gas bubbles, dirt, rust, scale and other particles from the casing surface so as to form a highly effective sealing bond between the cement column and the casing wall.

The method and apparatus of the present invention is an improvement over that described in my aforementioned U.S. Pat. No. 4,512,401 which is particularly useful in situations where the well is installed in a porous formation. When dealing with such porous formations, it has been found that with the method of my prior art patent, that a substantial portion of the cement will enter the porous formation thus failing to provide the desired sealing annulus around the casing with the quantity of cement normally employed. Thus, additional quantities of cement must be poured into the well bore in an attempt to achieve the desired end results and even then problems can be encountered in achieving the required sealing effect.

The method and apparatus of the present invention overcome the shortcomings encountered in the prior art where dealing with porous formations. This improvement is achieved by feeding the cement into the well in successive batches, such feeding being interrupted by periods long enough to enable the initial setting of the portion of the cement which enters the porous formation while the portion of the cement immediately adjacent to the casing wall is kept fluid by the continuous application of sonic energy thereto. In this manner, a sealing layer is formed over the porous formation while permitting the flow of successive batches of cement up the casing wall where the cement is kept fluidized until the cement annulus reaches the surface.

In carrying out the method of the present invention, the cement may be injected into the bottom of the well casing by means of an injector pipe which is installed within the casing, or if so desired, the cement may be fed directly into the casing as in my prior '401 patent, the teachings of which are incorporated herein by reference.

It is therefore an object of this invention to facilitate the installation of a cementitious annulus around the outer wall of a well casing where the well is in a porous formation.

Figure 1B:
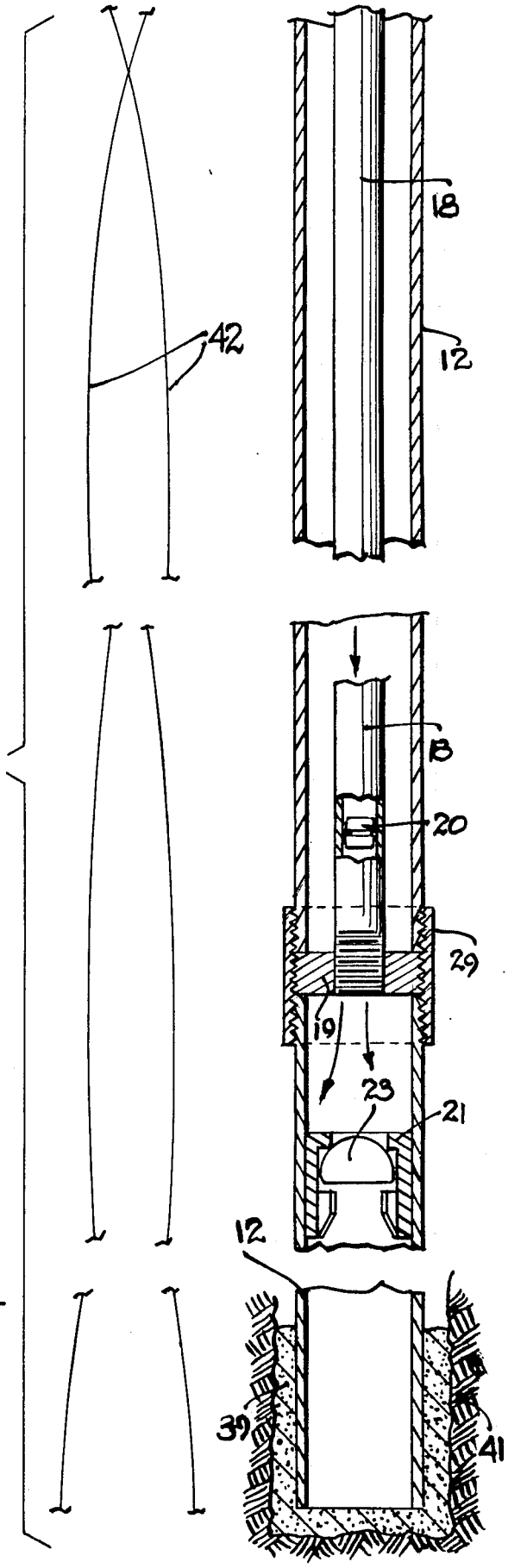

Other objects of this invention will become apparent as the description proceeds in connection with the accompanying drawings of which:

FIGS. 1A and 1B illustrate an embodiment of the invention.

Referring now to FIGS. 1A and 1B, an embodiment of the invention is illustrated. Sonic oscillator 10 may be of the type described in my U.S. Pat. No. 4,429,743 issued Feb. 9, 1984 capable of providing vibrational energy to casing 12 in a longitudinal vibrational mode. If so desired, the oscillator assembly may additionally include a second oscillator for providing sonic energy to the casing in a lateral vibrational mode such as described in my U.S. Pat. No. 4,403,665 or may include such a lateral oscillator in lieu of the longitudinal mode oscillator. Oscillator assembly 10 has a shaft 34 fixedly attached thereto as for example by welding, the shaft having a bulbous portion **34*a* at the extreme end thereof. Shaft 34 is fitted through an aperture formed in holder 36 which may be a commercially available side door elevator with a side door portion 36*a* which can be opened to receive shaft 34, this side door being closable with a safety latch 36*b*** to insure proper holding action. A typical such elevator which may be employed is the type SLX side door elevator commercially available from B. J. Hughes Co., Houston, Tex.

A second such holder or elevator member 30 is provided, this holder member being fitted around the casing 12 directly below collar 11 which is threadably attached to the casing. Link members 32 have eye portions **32*a* on the opposite ends thereof, these eye portions being fitted in the opposite apertured ends 36*b* and 30*b* of the holders 36 and 30 respectively. The casing 12 is thus suspended from oscillator 10 in tight engagement therewith, the top edge of holder member 30 abutting against collar 11 and the top edge of bulb portion 34*a* of shaft 34 abutting against the bottom edge of holder 36, thereby providing tight acoustic coupling to the casing for the sonic energy generated by oscillator 10**.

A flexible hose 38 is coupled to the top end of injector pipe 18 by means of threaded coupler member 27. Pipe 18 is centered and retained within casing 12 by means of bushing 13 which is threadably attached to the top end of the casing. Clamp ring **13*a* is bolted to bushing 13 by means of bolts 13*c* and clamps O-ring 13*b* against pipe 18 to form a sealing annulus. Circular bulkhead bushing 19 is clamped to adjoioning sections of casing 12 by means of clamp ring 29, this bushing being made of a soft material such as aluminum so that it readily can be drilled out after the cementing has been completed. The bottom end of pipe 18 is threadably attached to bushing 19. A travelling wiper plug 20 may be provided for use in purging pipe 18 of cement after the operation has been completed in the same manner as described in my aforementioned U.S. Pat. No. 4,512,401. A float shoe 21 is installed in the casing 12. This float shoe has a check valve 23 to prevent back flow of cement if the pressure is released in pipe 18 or if pipe 18 is unscrewed from its threaded engagement with bushing 19** and lifted up for cleaning.

In carrying out the method of the invention, sonic energy is provided in a continuous manner from oscillator 10 through the coupling to casing 12. This energy is preferably at a frequency such as to set up resonant standing wave vibration of casing 12 as indicated by graph lines 42. A first batch of cement is introduced into pipe 18 from hose 38. This cement flows down pipe 18 and out the bottom end thereof through valve 23 to the bottom of casing 12 and out along the sides thereof to form a cement annulus 39 which rises up along the outer walls of the casing. As previously noted some of this cement enters the surrounding porous earthen formation 41. It is to be noted that at this time plug 20 is not installed in the pipe.

After this first batch of cement has been poured, the sonic energy generated by oscillator 10 continues to be applied to casing 12 so that the portions of the cement immediately adjacent to the casing are kept in a fluidized condition. The portions of the cement which move into the earthen formation 41 are permitted to start to set to form a seal over these porous earthen portions. A time interval of a few minutes to a few hours, depending upon the set up time of the cement, which can be accelerated by adding calcium chloride, for example, is normally adequate to permit such sealing action. A lateral mode of vibrational energy will help to cause some of the cement to migrate into the porous side walls of the well bore to assure a complete wetting thereof. After the required time interval has been allowed, a second batch of cement is poured. This cement is free to migrate further up along the outer wall of casing 12 in view of the fact that the cement immediately adjacent to the side wall portions of the casing is maintained in a fluidized condition by the continuous application of sonic energy thereto. Again, a predetermined time interval is provided during which no cement is poured into pipe 18, during which time the cement is allowed to form a seal further up along the well bore and the cement along the outer walls of the casing is kept fluidized. Successive batches of cement are thus poured or pumped with intervals between each pouring operation until the cement annulus reaches the surface.

In some formations that are only slightly porous the batch technique can be approximated by pulsating the flow of injected cement, or by pumping during some intervals at a very slow rate.

Pipe 18 is then cleaned by means of wiper member 20 which is inserted at the top end of the pipe by removing coupler 27 and feeding water into pipe 18 to drive the wiper down the pipe and out through the bottom thereof. Bushing 19 and valve assembly 23 may later be drilled out of the casing. The frequency of oscillator 10 may be adjusted to provide standing wave vibration of casing 12 as indicated by graph lines 42. This oscillatory sonic vibration may be either in a longitudinal mode, lateral mode or a combination of both depending on the particular application requirements.

In carrying out the method of the invention, the cement may be fed directly to the casing without the use of pipe member 18 but rather utilizing the same basic hardware shown in my U.S. Pat. No. 4,512,401. The use of the injector pipe which is removed after the operation has been complete has the advantage of avoiding any deposit of cement on the inside wall of the casing. The cement is pumped into pipe 18 and thus is efficiently forced through the pipe out through the bottom of the casing in successive "injection" stages.

While the invention has been described and illustrated in detail, it is to be clearly understood that this is intended by way of illustration and example only and is not to be taken by way of limitation, the spirit and scope of the invention being limited only by the terms of the following claims.

I claim:

1. A method for forming an annulus around the outer wall of a well casing installed in a well bore, said well bore being formed in a porous formation comprising the steps of, pouring a first batch of cement down to the bottom of the casing and out from the bottom end thereof and up along the outer walls of the casing, while the cement is being poured continually applying sonic energy to the casing to maintain portions of cement immediately adjacent to said casing in a fluidized state, after said first batch of cement has been poured containing the application of said sonic energy to the casing while interrupting the introduction of cement into said casing for a predetermined period to permit a portion of said cement along the porous side wall of said well bore to initiate setting while a portion of the cement immediately adjacent to the casing is maintained in a fluidized condition, after said predetermined period has expired, pouring a second batch of cement to the bottom of said casing, said second batch of cement being permitted to rise along the outer wall of the casing through the fluidized cement along the casing wall the application of sonic energy to the casing being continued while the second batch of cement is being poured, when said predetermined period has expired, continuing the application of sonic energy to the casing to maintain the cement along the casing wall fluidized while the portions of cement along the wall bore initiates setting, continuing with the aforementioned steps in succession until an annulus of cement has been formed around the casing, ceasing the application of sonic energy to the casing to permit all of the cement to set.

2. The method of claim 1 wherein the cement is injected into the casing through an elongated pipe installed within the casing to a point near the bottom end of the casing.

3. The method of claim 1 wherein the steps are integrated by pulsating the flow or by pumping slowly for an interval.

* * * * *